United States Patent [19]

Lasky et al.

[11] 4,097,884

[45] Jun. 27, 1978

[54] APPARATUS AND METHOD FOR AUTOMATICALLY PROCESSING X-RAY FILM

[75] Inventors: Daniel J. Lasky, Santa Clara; Philip R. Wright, San Jose, both of Calif.

[73] Assignee: Adex Corporation, Santa Clara, Calif.

[21] Appl. No.: 726,242

[22] Filed: Sep. 24, 1976

[51] Int. Cl.[2] ..... G03D 3/08

[52] U.S. Cl. ..... 354/323; 354/331; 137/624.18

[58] Field of Search ..... 354/316, 324, 323, 326, 354/331; 134/57, 58, 100, 101; 137/624.18

[56] References Cited

U.S. PATENT DOCUMENTS

| | | | |
|---|---|---|---|
| 2,989,911 | 6/1961 | Winnek | 354/323 X |
| 3,672,288 | 6/1972 | Deltoro | 354/323 |
| 3,842,587 | 10/1974 | Strauss et al. | 354/30 |

*Primary Examiner*—L. T. Hix
*Assistant Examiner*—William B. Perkey
*Attorney, Agent, or Firm*—Boone, Schatzel, Hamrick & Knudsen

[57] ABSTRACT

A method and apparatus for processing X-ray film comprising a processing tank having a port in its lower portion, three solenoid valves each having an outlet coupled to the port and operative to allow a developer solution, a fixer solution and water to flow through the respective valve, a drain solenoid valve having an inlet connected to the port and an outlet and being operative to allow working solutions to drain from its inlet to its outlet, sources of photographic developer solution and fixer solution for supplying developer solutin and fixer solution to the respective inlets of two of the valves, a source of water having an orifice connected to the inlet of the third valve, the water having a pressure which is in a predetermined range between a first pressure and a second pressure and being subject to variations, the orifice having a dimension sufficient to provide a turbulent flow of water to the tank when the water valve is open, and an electrical system for selectively supplying electrical signals to the valves to control the operation of the valves and to permit developer working solution, fixer working solution, or water to turbulently flow into or drain from the tank when the pressure is in the predetermined range.

16 Claims, 6 Drawing Figures

Fig_5

| | CONTROLLED FUNCTIONS | | | | | TIME PERIODS (RESISTORS) | | | | | | | |
|---|---|---|---|---|---|---|---|---|---|---|---|---|---|
| STEP | WATER | DRAIN | DEVELOPER | FIXER | LEVEL SENSE | RA | RB | RC | RD | RE | RF | RG | PROCESS FUNCTION |
| ON | | X | | | | | | | | | | | AUTOMATIC DRAIN |
| START | | | | | | X | | | | | | | START |
| 1 | X | | | | | | X | | | | | | PRE-SOAK |
| 2 | | X | | | | | | X | | | | | DRAIN |
| 3 | X | | X | | X | | | | | | | | FILL DEVELOPER |
| 4 | | | | | | | | | X | | | | DEVELOP |
| 5 | X | | | | | | | | | | X | | WASH |
| 6 | | X | | | | | | X | | | | | DRAIN |
| 7 | X | | | X | X | | | | | | | | FILL FIXER |
| 8 | | | | | | | | | | X | | | FIX |
| 9 | | X | | | | | | X | | | | | DRAIN |
| 10 | X | | | | | | | | | | | X | WASH |
| 11 | | X | | | | | | X | | | | | DRAIN |
| 12 | | | | | | | | | | | | | END PROCESS/LOGIC RESET |
| WASH | X | | | | | | | | | | | | MANUAL WASH |
| END WASH | | X | | | | | | | | | | | AUTOMATIC DRAIN |

APPARATUS AND METHOD FOR AUTOMATICALLY PROCESSING X-RAY FILM

BACKGROUND OF THE INVENTION

1. Field of the Invention

The present invention relates generally to the field of processing x-ray film, and more particularly, to an apparatus and method for automatically processing x-ray film in which the chemicals are moved to the film.

2. Description of the Prior Art

Heretofore, x-ray film processors have employed a complex conveyor system for transporting sheets of x-ray film through baths of processing chemicals during the developing process. Such a conveyor system typically comprises upwards of ninety rollers and their associated bearings, gears, motors and pumps for carrying a sheet of x-ray film through stainless steel tanks, holding a developer, a fixer and a wash, which are maintained at a precisely controlled elevated temperature of between 84° F and 86° F. A sensing system is employed to sense the presence of the film and to actuate the transport system while the film is in the processor. In operation, the film is placed on an in-feed conveyor and detected by the sensing mechanism. The conveyor then transports the film through the developer tank, a cross-over section which squeezes excess developer from the film to prevent it from contaminating the fixer, the fixer tank, another cross-over section, and the wash tank. From the wash tank, the film is transported through a third cross-over section to a heater and blower section which serves to dry the film before it exits the processor. Because the film is successively transported through, and immersed in, the several chemicals, scum caused by the emulsions, etc., tends to build up on the conveyor system. Consequently, the moving parts of the conveyor such as the rollers, gears and the like are subject to mechanical failure and are required to be frequently cleaned and maintained. Failure of a moving part during processing generally causes the film in the processor to be ruined. When this occurs the patient must be re-exposed to the potentially hazardous x-rays.

Relative to the development of the x-ray film it should be noted that development is determined by four parameters; agitation, chemical concentration; temperature and time. In a processor of the type described, the x-ray is typically transported through the developer in a shear direction relative to the developing medium and in about 1-½ minutes. During this time the conveyor system has been found to block the developer from contacting the surface of the film in such a manner as to hinder agitation and hence development. Moreover, since the film moves in a shear direction, agitation and development activity is further decreased. In order to compensate for these problems, heat and a relatively strong chemical concentration of developer and fixer are required to provide x-rays of the required quality. More particularly, constantly running hot and cold water at a controlled temperature between 84° F and 86° F and a controlled pressure between 30 and 50 p.s.i. are required to maintain the chemicals at a predetermined temperature during the process. Furthermore, since the film is transported by a common conveyor the time required for the film to pass through any of the chemicals cannot be selectively adjusted or changed without effecting the time period that the film passes through the other chemicals.

SUMMARY OF THE PRESENT INVENTION

It is therefore an object of the present invention to provide an efficient, reliable apparatus for processing x-ray film and the like in a relatively short time and at a relatively low cost.

Another object of the present invention is to provide an apparatus which serves to move the processing chemicals in an agitated state to the film.

Still another object of the present invention is to provide an apparatus that is operable with tap water and does not require precisely controlled temperatures to accomplish the developing operation.

Yet another object of the present invention is to provide a compact apparatus for processing x-ray film which is capable of processing batches of film in a relatively short time.

Yet another object of the present invention is to provide a method for economically and automatically processing sheets of x-ray film that uses relatively dilute chemicals.

Briefly, the preferred embodiment comprises a processing tank having a first port disposed generally in its lower portion, which serves to provide an inlet and an outlet for working solutions, a first valve having a first inlet, a first outlet and a first electrical control terminal, the first valve being normally closed and further being responsive to a first signal applied to the first terminal and operative to allow a developer solution to flow from its inlet to its outlet, a second valve having a second inlet, a second outlet and a second electrical control terminal, the second valve being normally closed and further being responsive to a second signal applied to the second terminal and operative to allow a fixer solution to flow from its inlet to its outlet, a third valve having a third inlet, a third outlet and a third electrical control terminal, the third valve being normally closed and further being responsive to a third signal applied to the third terminal and operative to allow water to flow from its inlet to its outlet, conduit interconnecting the first, second and third outlets and the first port, a fourth valve having a fourth inlet connected to the conduit, a fourth outlet and a fourth electrical control terminal, the fourth valve being normally closed and further being responsive to a fourth signal applied to the fourth terminal and operative to allow working solutions to flow from its inlet to its outlet, a source of photographic developer solution for supplying developer solution to the first inlet, a source of photographic fixer solution for supplying fixer solution to the second inlet, a source of water having an orifice connected to the third inlet, the water having a pressure which is in a range between a first pressure and a second pressure and being subject to variations, the third orifice having a dimension sufficient to provide a turbulent flow of water to the tank when the third signal is applied to the terminal and the pressure exceeds the first pressure, and an electrical system for employing a shift register for selectively supplying first, second, third and fourth signals to the first, second, third and fourth terminals, respectively. When the first and third signals are applied developer working solution turbulently flows into the tank via the first and third valves, when the second and third signals are applied fixer working solution turbulently flows into the tank via the second and third valves, when the third signal is applied water turbulently flows into the tank via the third valve, and when the fourth signal is applied the working solutions filling the tank are permitted to drain through the fourth outlet. This serves to process sheets of x-ray film when the pressure is in the predetermined range.

In a second embodiment, a method of processing x-ray film comprises the steps of providing a processing tank having a port in its floor and having x-ray film disposed therein, supplying a turbulent flow of water through the port to pre-soak the film, draining the tank, supplying a turbulent flow of developer working solution through the port, supplying a turbulent flow of water through the port to cause the developer working solution to overflow and in turn be removed from the tank, draining the tank, supplying a turbulent flow of fixer working solution through the port, draining the tank, supplying a turbulent flow of water through the port and draining the tank.

An advantage of the present invention is that it provides an efficient, safe, reliable, compact apparatus for processing x-ray film in a relatively short time and at a relatively low cost.

Another advantage of the present invention is that it moves the processing chemicals to the film in an agitated state and in such a manner as to conserve the use of the chemicals.

Still another advantage of the present invention is that it utilizes tap water having a pressure that varies over a great range and does not require maintaining the chemicals at a predetermined temperature during processing.

Yet another advantage of the present invention is that it is capable of processing batches of x-ray film with relatively dilute chemicals in a relatively short time and that it enables the independent and selective adjustment of the duration of an operative step in such a manner that the duration of other steps are not affected.

Other objects and advantages of the present invention will no doubt become apparent to those skilled in the art after having read the following detailed description of the preferred embodiments which are illustrated in the several figures of the drawing.

IN THE DRAWING

FIG. 5 is a chart illustrating the operation of the apparatus of FIG. 1; and

DETAILED DESCRIPTION OF THE PREFERRED EMBODIMENTS

Figure 1:
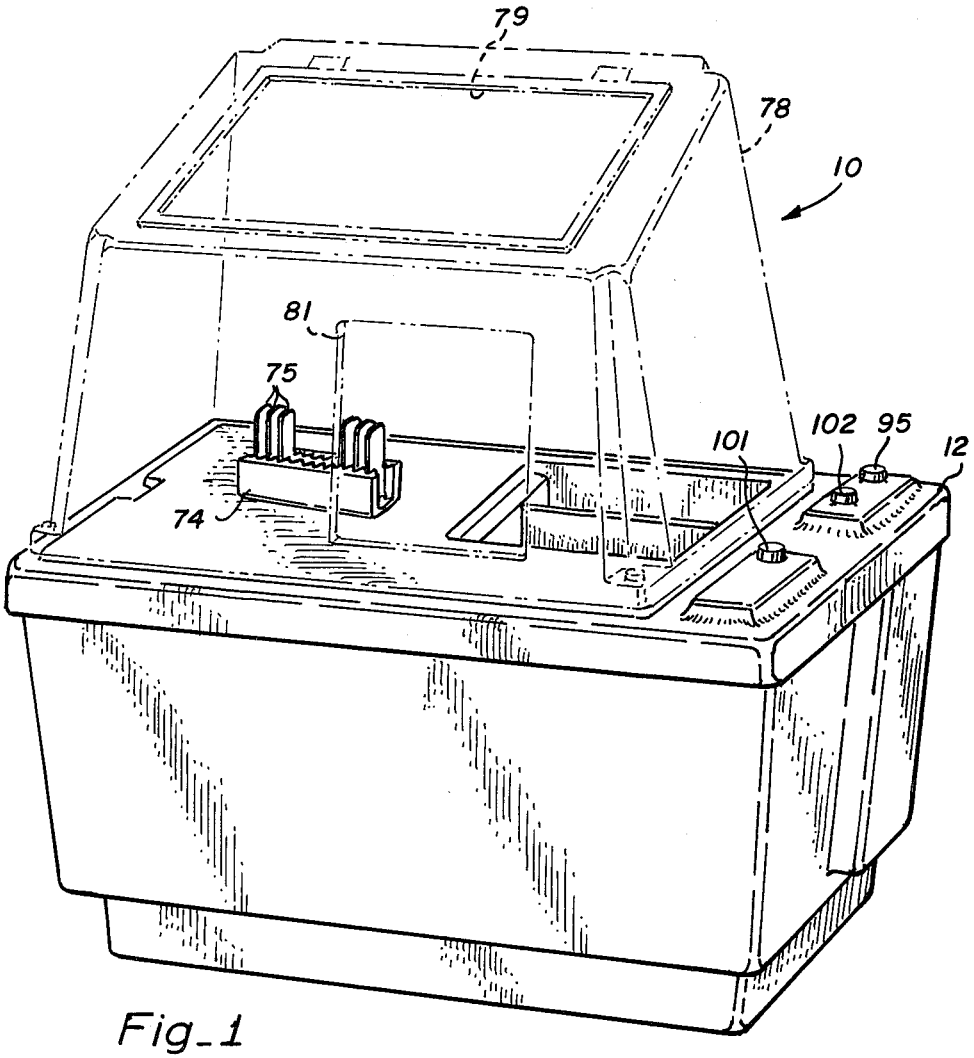
FIG. 1 is a perspective view of an apparatus for processing x-ray film in accordance with the present invention.
Figure 2:
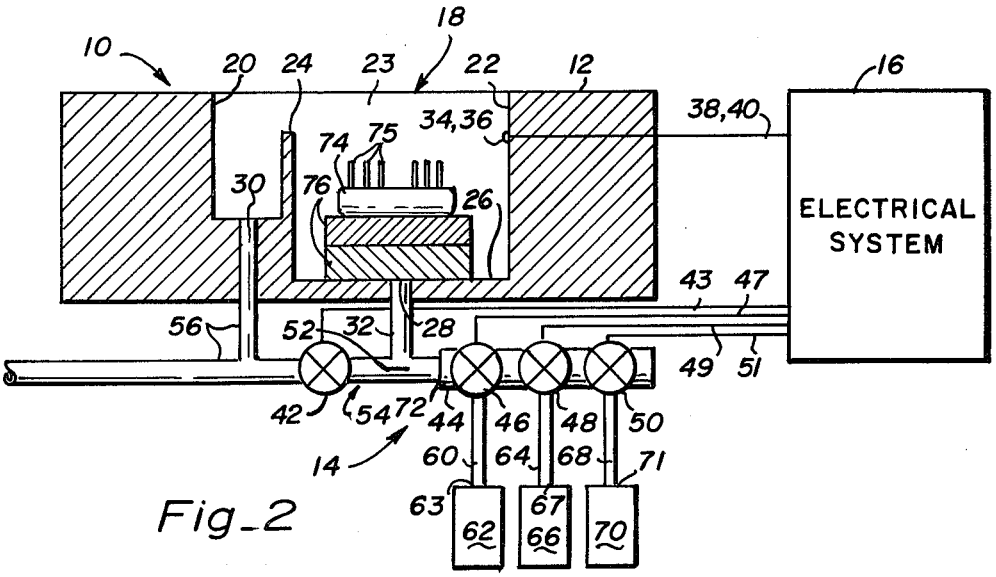
FIG. 2 is a cross-section view diagrammatically illustrating the apparatus of FIG. 1.

Referring now to FIGS. 1 and 2 of the drawing, an apparatus 10 for processing x-ray film in accordance with the present invention is illustrated in a perspective and in a cross-section view. As shown, the apparatus 10 comprises a processing station 12, a hydraulic system 14, and an electrical system 16.

The processing station 12 includes a processing tank, or well 18, that is of a generally rectangular shape in plan view and is formed by a rear wall 20, a front wall 22, opposed side walls 23, a spillway wall 24 and a floor 26 with an opening or port 28. The walls and floor are comprised of a chemically inert material, such as a high impact vinyl with chemical resistance to the chemicals utilized in the processing steps. The upper surface of the spillway wall 24 lies below that of the front and back walls so as to provide a weir. Consequently, when the tank 18 is filled with fluid to a level above the height of the weir, the fluid spills into a spillway formed between the spillway wall 24 and the rear wall 20 from where it is carried by gravity through a drain 30. The opening 28 formed in the floor 26 is connected to a conduit 32 and serves to provide an inlet and an outlet for working solutions flowing into or out of the tank 18. A pair of spaced apart electrodes 34 and 36 are embedded in the front wall 22 at a location below the upper surface of the spillway wall and are connected via conductors 38 and 40, respectively, to the electrical system 16 and serve to provide a level sensor for providing an indication when fluid in the tank reaches a predetermined level. In a manner which will be subsequently described, with no fluid in the tank, a relatively high electrical resistance exists between the electrodes 34 and 36. Subsequent filling of the well with water, developer or fixer, all of which have a relatively high electrical conductivity, causes the resistance to decrease substantially. This provides an effective short circuit to occur between the electrodes 34 and 36 and hence a conduction path for a voltage impressed on the electrode 34.

The hydraulic system 14 comprises a drain solenoid valve 42 having an electrical control terminal 43 (see FIG. 3), a manifold 44 comprising a fixer solenoid valve 46 having an electrical control terminal 47, a developer solenoid valve 48 having an electrical control terminal 49, and a water solenoid valve 50 having an electrical control terminal 51, conduit 52 connecting the manifold 44 and the conduit 32, conduit 54 connecting the conduit 32 and the drain solenoid valve 42 and conduit 56 conncted to the outlet of the drain solenoid valve 42 and the drain 30 for removing the fluids from the system.

The solenoid valves are preferrably 3-way electrically actuated solenoid valves such as those manufactured by the Richdel Corporation and designated by them as Model R-759-12VDC. Each of the valves is normally closed so as to prevent fluid flow therethrough. In response to an electrical signal applied to its control terminal, the valve opens and remains open until the signal terminates. Accordingly, the drain solenoid valve 42 serves to control the flow of fluids exiting the drain 28, and also, when in the closed position serves to divert fluids exiting the manifold 44 into the well 18. The fixer solenoid valve 46 is connected by conduit 60 to a pressurized tank 62 of fixer solution having an orifice 63. The orifice 63 is selected to provide a predetermined fixer flow, and a corresponding dilution when mixed with water from the water source 70, and also to cause the working solution to exit the manifold, and hence be supplied to the well, in a turbulent flow. When actuated the valve 46 serves to provide a path for the fixer solution to flow from the tank 62 to the well 18 via the conduit 52 and 32 and the opening 28. Similarly, the developer solenoid valve 48 is connected by conduit 64 to a pressurized tank 66 of developer fluid having an orifice 67. The orifice 67 is selected to provide a predetermined developer flow, such flow being sufficient to cause the diluted developer to have a turbulent characteristic as it enters the tank 18. When actuated the valve 48 enables the turbulent developer to fill the tank 18 through the opening 28. The water solenoid valve 50 is connected by conduit 68 to a pressurized source 70 of water having an orifice 71 and when actuated enables water to enter the tank 18 through the port 28.

The source 70 is generally a faucet providing tap water to the system. As is well known, tap water generally has a temperature that can vary between 55° F and 85° F and a pressure that is generally unregulated and can vary between 30 and 90 pounds per square inch (p.s.i.).

Because of the wide range of water pressures that are capable of being supplied, the flow of water through the conduit 68 also varies greatly. This in turn causes the concentration of the diluted solutions of developer and fixer to vary in a corresponding manner for a preselected orifice 71. It is a feature of this invention to provide orifices 63, 67 and 71 having preselected diameters such that with the lowest water pressure available, i.e., 30 p.s.i., the diluted fixer and developer enters the well 18 with sufficient turbulence to provide the required agitation. It should be noted that as water pressure and hence dilution increases turbulence also increases, thus enabling lower chemical concentrations to effect a similar development result.

In the preferred embodiment, the orifice 67 is 0.031 inches in diameter and provides a developer concentrate flow of 0.23 gallons per minute (gpm) at a pressure of 10 p.s.i.; the orifice 63 is 0.078 inches in diameter and provides a fixer concentrate of 0.80 gpm at a pressure of 10 p.s.i.; and the orifice 71 is 0.125 inches in diameter and provides a water flow of 2.3 gpm at 30 p.s.i. For this example, the resultant developer working solution consists of ten parts water and one part developer and the fixer working solution consists of about three parts water and one part fixer. When the water pressure reaches 90 p.s.i. the developer dilution changes to about 20 to 1 and the fixer dilution changes to about 4.5 to 1. Because of the increased turbulence, such diluted working fluids entering the well have been found to produce acceptable process results.

It should be noted that the water solenoid valve 50 is disposed away from the outlet 72 of the manifold 44. This enables the water to flush out any residual traces of the developer or the fixer present in the manifold 44 or the conduit 52 as it flows into the tank 18. Under the control of appropriate signals to the control terminals 43–51 in a manner as will be subsequently described in detail, the developer, fixer, water and drain solenoid valves are selectively actuated to enable the selected fluids to turbulently flow into the well (or to be drained from the well).

The well 18 is adapted to receive a rack 74 carrying a plurality of sheets 75 of x-ray film. The rack 74 is typically one having fourteen slots and that is capable of holding $1\frac{1}{4}$ by $1\frac{5}{8}$ inch sheets, although racks capable of holding sheets of other sizes and in other quantities can also be employed. When immersed in the well, the top surface of the film must be below the electrodes 34 and 36. With sheets of the size described and since the rack is relatively small compared to the depth of the well, filler blocks 76 are placed on the floor 26 under the rack in order to conserve the quantities of chemicals that are used. Removal of the filler blocks 76 increases the capacity of the tank and enables several racks of film to be developed during a process.

Another feature of the present invention is the inclusion of a daylight loader 78 shown in dashed lines in FIG. 1 and disposed in a covering relationship over the well 18. The loader 78 includes a window, or filter 79, formed from a material such as plexiglass which prevents light of preselected wavelengths that would expose the film from being transmitted therethrough while permitting the well to be visually observed as the x-ray film is being processed. A pair of doors 81 (only one of which is shown) covered by light-tight flaps enable the operator to manipulate the film 75 within the loader 78 while preventing its reexposure.

Figure 3:
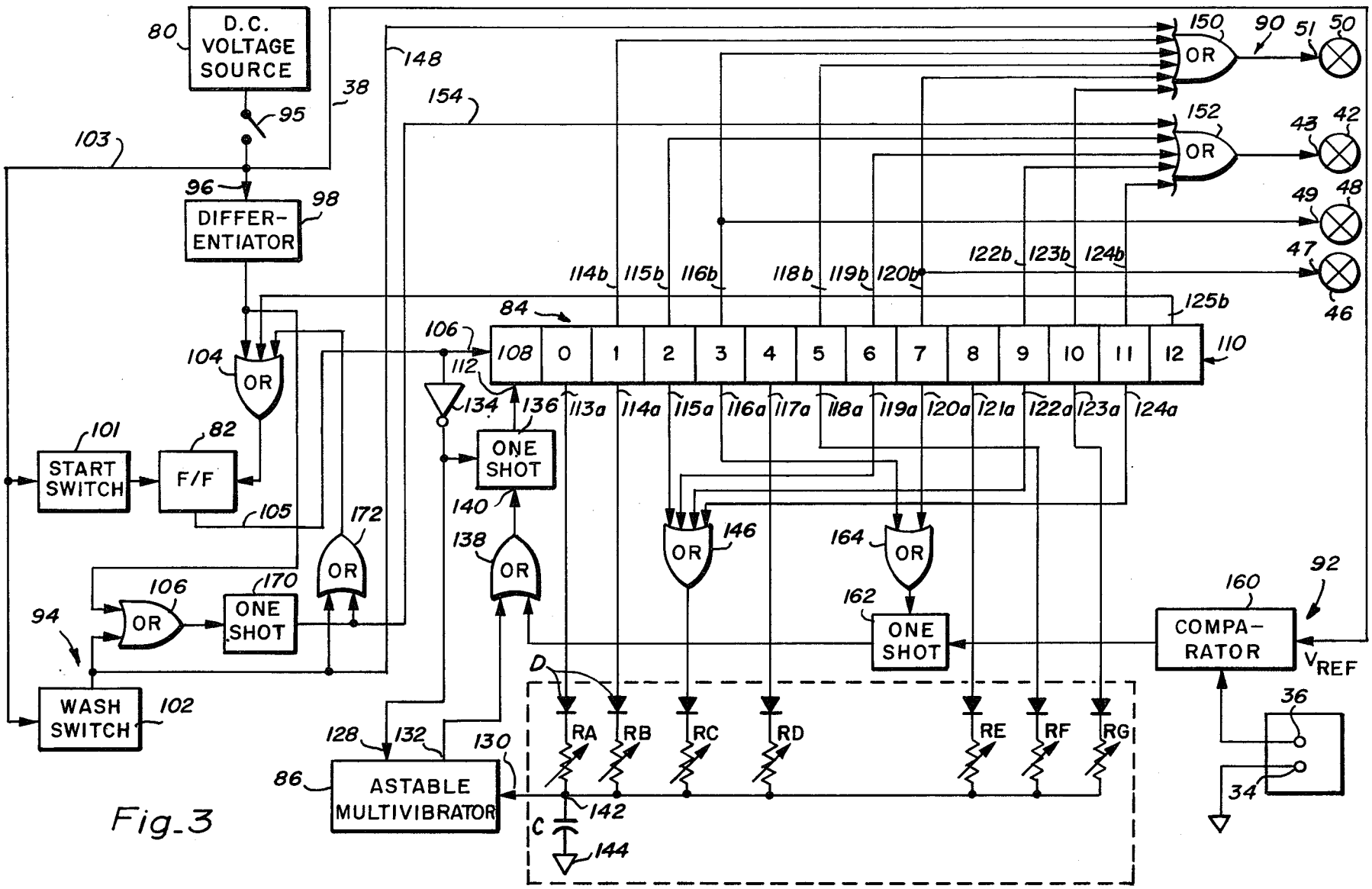
FIG. 3 is a schematic diagram of the electronic system of the apparatus of FIG. 1.

Referring now to FIG. 3, the electrical system 16 is diagrammatically illustrated. The system includes a source 80 of DC voltage, a master flip-flop 82, a step register or up counter 84, an astable multivibrator 86, a timing circuit 88, a valve control circuit 90, a level sensing circuit 92 and a manual wash circuit 94.

The source 80 is connected through a switch 95 and a conductor 96 to a differentiator 98 which provides a differentiated signal when the switch 95 is depressed. The output of the switch 95 is also connected to an input of the comparator 160 via conductor 38 and to a start switch 101 and a manual wash switch 102 via the conductor 103. The output of the differentiator 98 is connected to an input of OR gates 104 and 106 which serve to conduct signals applied to their input terminals. The output of the OR gate 104 is connected to an input of the master flip-flop 82 which has another input connected to the start switch 101 and an output connected by a conductor 105 to the enable terminal 106 of the step register 84. The output of the flip-flop 82 is normally in the high state. The flip-flop 82 is responsive to a positive pulse applied at its input and is operative to switch the state of the signal appearing on its output. Accordingly, when the switch 95 is closed and switch 101 is depressed, the flip-flop 82 provides an enable signal to the enable terminal 106.

The step register 84 includes a control portion 108 and a counter portion 110 with the enable terminal 106 and an advance terminal 112 connected to the control portion 108. The counter portion 110 includes output terminals 113–125 representative of the thirteen output positions, designated as 0–12 in FIG. 3. The step register 84 serves to provide a positive output signal on one of the terminals 113–125 and to sequentially step upwardly to provide an output signal at the next position or terminal in response to the simultaneous application of a signal having a low state on terminal 106 and a negative pulse on advance terminal 112. In the preferred embodiment the step register 84 comprises two identical decade counters manufactured by the Radio Corporation of America and designated by them as the Model CD4017 which are configured in a cascade fashion and interconnected with a JK flip-flop. The astable mutivibrator 86 includes input terminals 128 and 130 and an output terminal 132. An inverter 134 is connected between the conductor 105 and the terminal 128 and serves to apply an inverted enable signal to the multivibrator 86. The signal on the output terminal 132 is normally high. The multivibrator 86 serves to provide an output signal that switches to the low state when the signal applied to its input terminal 128 is high and that applied to its input terminal 130 transitions from a low to a high state. By selectively varying the frequency at which the signal applied to terminal 130 transitions the duty cycle of the output signal produced by the astable multivibrator is made to change in a corresponding manner. The output terminal 132 of the multivibrator 86 is coupled through an OR gate 138 to an input terminal 140 of a one-shot 136 which has another input terminal connected to the output of the inverter 134 and an output connected to the terminal 112. The one-shot 136 serves to provide an advance pulse to the control portion 108 of the step register 84 when the inverted enable signal is applied to one input and the signal applied to its other input transitions from high to low, e.g., at a time corresponding to the trailing edge of the output signal of the multivibrator 86.

The timing circuit 88 comprises a differentiating circuit including resistors RA, RB, RC, RD, RE, RF and RG, each having a common terminal 142 connected to the input 132 of the astable multivibrator 86 and to one plate of a capacitor C. The opposed plate of the capacitor is connected to ground 144. Each of the resistors or potentiometers RA–RG is of the variable type and has a resistance which is capable of being adjusted. As will be subsequently described, the resistors RA–RG are capable of being selectively connected to the input 132 and serve to control the frequency of oscillation and hence the duty cycle of the astable multivibrator 86. In the preferred embodiment, the astable multivibrator 86 and the timing circuit 88 are included in a timer circuit manufactured by the Signetics Corporation and designated by them as Model NE555.

In the timing circuit 88 the resistors RA–RG are coupled to selected output terminals of the step register 84. Accordingly, a signal is provided to the input terminal 130 of the astable multivibrator when the step register is advanced to provide an output through one of the resistors. More specifically, the resistor RA is coupled to the terminal 113*a* and serves to effect the duty cycle when the step register 84 is in position 0; the resistor RB is copuled to the terminal 114*a* and effects the duty cycle when the step register is in position 1; and the resistor RC is coupled to the output of an OR gate 146 which has its inputs connected to the terminals 115*a*, 119*a*, 122*a* and 124*a*. The resistor RC effects the duty cycle when the step register 84 is in either positions 2, 6, 9 or 11. Similarly, the resistor RD is coupled to the terminal 117*a* which corresponds to position 4 of the step register; the resistor RE is coupled to the terminal 121*a* which corresponds to position 8 of the step register; the resistor RF is coupled to the terminal 118*a* which corresponds to position 5 of the step register; and the resistor RG is coupled to the terminal 123*a* which corresponds to position 10 of the step register. A blocking diode D is serially connected to each of the resistors RA–RG to prevent an output signal supplied on one of the terminals of the step register from being conducted to another output terminal. As will be hereinafter described in detail, the value of resistance of each of the resistors RA–RG is chosen to provide the desired duration of each step in chemically processing x-ray film with the apparatus 10.

The valve control circuit 90 comprises the interface to the control terminals 43–51 of the valves 42–50 and serves to actuate such valves at predetermined times to produce the desired development of the x-ray film. As shown in FIG. 3, the inputs of an OR gate 150 are connected to the output terminals 114*b* (position 1), 116*b* (position 3), 118*b* (position 5), 120*b* (position 7), 123*b* (position 10) and conductor 148 (manual wash circuit 94), its output being connected to the control terminal 51 of the water valve 50. The OR gate 150 serves to actuate the water valve 50 when a signal is applied to any of its inputs. Also, the inputs of an OR gate 152 are connected to a conductor 154 of the manual wash circuit 94, the output terminal 115*b* (position 2), 119*b* (position 6), 122*b* (position 9), and 124*b* (position 11), its output being connected to the control terminal 43 of the drain valve 42. The OR gate 152 serves to actuate, e.g., open, the drain valve in response to a signal on any of its inputs. In addition, the output terminal 116*b* (position 3) of the step register 84 is also directly coupled to the control terminal 49 of the developer valve 48 and serves to open such valve along with the water valve when a signal is applied to the terminal. Also, the output terminal 120*b* is connected to the control terminal 47 of the fixer valve 46 and serves to open such valve when the step register is in position 7; and the output terminal 125*b* (position 12) is connected to an input of the OR gate 104 and serves to supply a reset pulse to the master flip-flop 82 when the step register completes its cycle.

The level sensing circuit 92 comprises the electrodes 34 and 36, the comparator 160 having an input connected to the electrode 36 and an input connected to the source of reference potential, $V_{REF}$ and an output, and a one-shot 162 having an input connected to the output of the comparator 160, an input connected to the output of an enable OR gate 164 and an output connected to an input of the OR gate 138. The OR gate 164 has its inputs connected to the terminals 116*a* and 120*a* and hence conducts a signal when the step register 84 is in positions 3 or 7. The comparator 160 serves to provide an output signal to the one-shot 162 when the fluid in the tank reaches the level of the electrodes 34–36. The one-shot 162 provides an output pulse in response to the application of a signal from the comparator 160 and from the OR gate 154 at a time corresponding to that of the trailing edge of the signal conducted through the OR gate. In a manner as previously described relative to the operation of the astable multivibrator 86, the output signal from the one-shot 162 is conducted through the OR gate 138 to trigger the one-shot 136 which in turn causes the step register to advance.

The manual wash circuit 94 comprises the manual wash switch 102, the OR gate 106, a one-shot 170 coupled to the OR gate 106 and an OR gate 107. The switch 102 is connected to an input of the OR gate 106 and via the conductor 148 and the OR gate 150 to the water valve 50. Hence, when the switch 102 is closed the water valve 50 opens and a signal is conducted through the OR gate 172 and the OR gate 104 to reset the master flip-flop 82. The one-shot 170 provides a pulse having a generally long duration or at a time corresponding to the opening of the switch 102, e.g., the signal conducted via conductor 154 and the OR gate 152 to the drain valve 42 and through the OR gates 172 and 104 to the master flip-flop 82. The pulse serves to open the drain valve and to hold the flip-flop 82 reset. In addition, since the output of the differentiator 98 is connected to an input of the OR gate 106, the pulse is also produced when the switch 95 is closed and the differentiator 98 is actuated.

Figure 4:
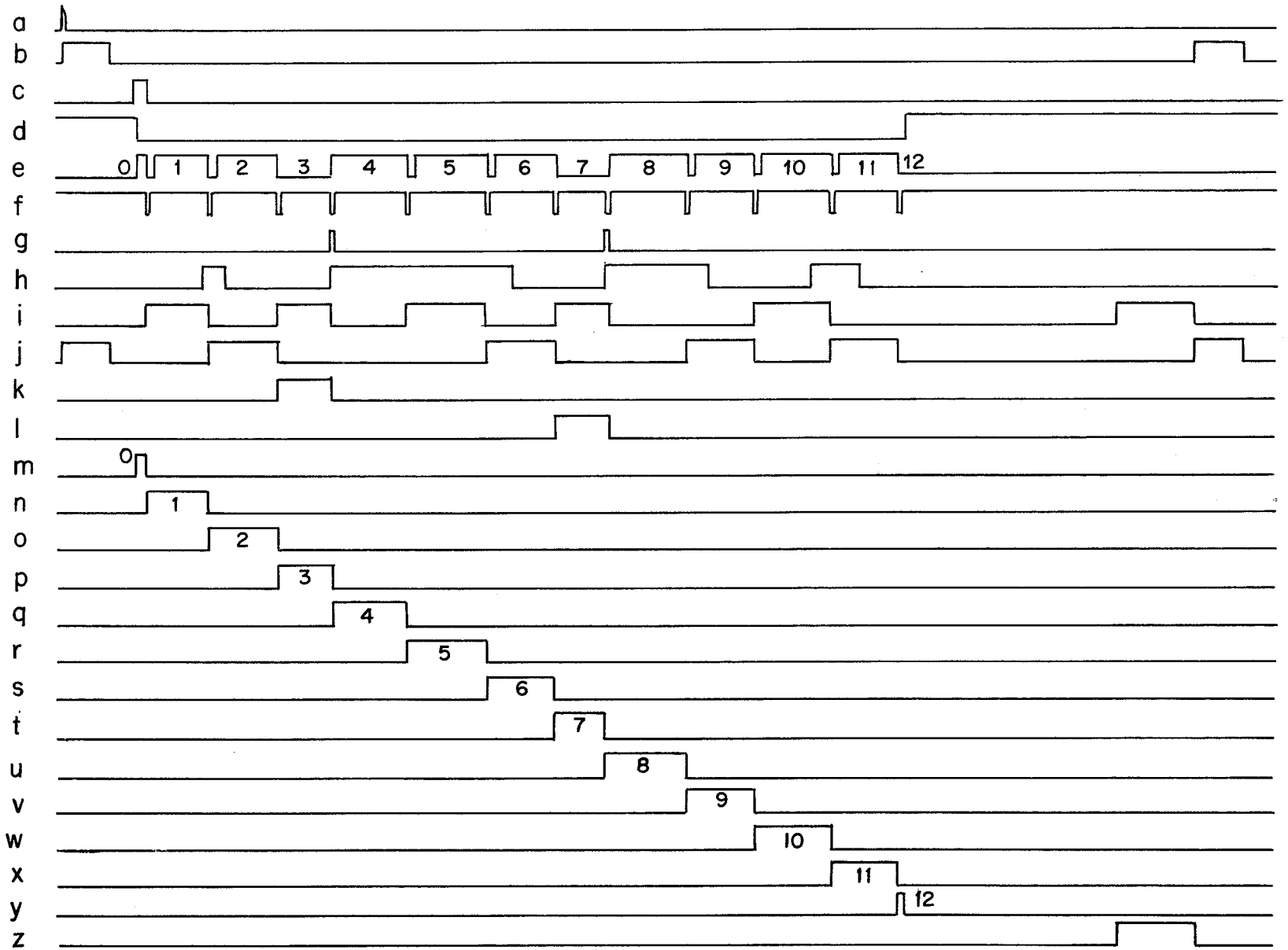
FIG. 4 is a timing diagram for the electronic system illustrated in FIG. 3.

Referring to FIG. 4, the waveforms of the signals encountered at various points in the system of the present invention are illustrated. FIG. 4*a* represents the waveform of the signal developed by the differentiator 98. As shown, this signal is a positive-going spike having a relatively short duration commencing at the time the switch 95 is closed. FIG. 4*b* represents the waveform of the signal developed at the output of the one-shot 170 in response to the application of a signal from the differentiator 98 or upon the closing of the manual wash switch 102. FIG. 4*c* represents the signal developed when the start switch 101 is closed. FIG. 4*d* represents the signal developed at the output of the master flip-flop 82. As shown the signal goes from a high state to a low state after the closing of the start switch 101 and returns to the high state in response to a signal from the step register 84 at a time when the output of the register reaches the 12th or final position. FIG. 4*e* represents the waveform of the signal generated by the astable multivibrator 86 and illustrates the variation in duty cycle of such signal during the process. FIG. 4*f* illustrates the waveform produced by the one-shot 136 and includes a string of negative-going advance pulses provided at times corresponding to that of the trailing edges of the signal produced by the astable multivibrator. FIG. 4*g* illustrates the waveform produced by the one-shot 162. FIG. 4*h* illustrates the waveform produced by the comparator 160. FIGS. 4*i* through 4*l* illustrate the bistate waveforms of the actuating signal applied to the control terminals of the water valve 50, drain valve 42, developer valve 48 and fixer valve 46, respectively. The high state indicates that the valve is open and the low state indicates that the valve is closed. FIGS. 4*m* through 4*y* illustrate the waveforms of the signals produced at the output terminals 113–125 of the step register 84 as the output is advanced through the zero through 12 positions, respectively. The positions 0–12 are designated in the figures by the identical numeral. FIG. 4*z* illustrates the signal produced at the output of the switch 102 during the manual wash operation.

The operation of the present invention will hereafter be described with reference to FIG. 5 which is a chart diagrammatically illustrative of the several process steps. When switch 95 is closed, voltage is applied from the source 80 to the differentiator 98, to the comparator 160 and to the start and manual wash switches 101 and 102, respectively. The differentiator 98 produces the signal illustrated in FIG. 4*a* which is conducted through the OR gate 106 to initiate the one-shot 170 which in turn supplies the extended pulse via conductor 154 and OR gate 152 to actuate the control terminal 43 of the drain valve 42. This actuates the drain valve 42 causing the valve to open and permitting a path for any fluid remaining in the well 18 to flow to the outlet 56. The output of the one-shot 170 is also conducted through OR gates 172 and 104 to reset the master flip-flop 82 in such a manner as to provide a system interlock. This prevents the master flip-flop 82 from changing state if the start switch 101 is inadvertently depressed while the drain 42 is open. The drain valve 42 is caused to close when the output level of the one-shot 170 falls to a low state. In addition, the differentiated signal is applied through the OR gate 104 to reset the master flip-flop 82.

At this time, the rack 74 carrying the x-ray film to be developed is placed on the blocks 76 in the well 18. Upon the depression of the start switch 101, the master flip-flop 82 is set, causing its output signal to go low and to provide an enable pulse via conductor 105 to the enable termianl 106 of the step register 84. In addition, the enable signal is inverted by the inverter 134 and applied to the one-shot 136 and to the input terminal 128 of the astable multivibrator 86. This enables the step register 84 and the astable multivibrator 86. The high output (in position 0) on terminal 113*a* is applied through the timing resistor RA to the terminal 130 of the astable multivibrator 86 which in turn causes the output at terminal 132 to go high. In the preferred embodiment the resistance of the resistor RA is relatively small so that the output at terminal 132 remains high for only a short period (see FIG. 4*e* position 0). This triggers the one-shot 136 which produces an advance pulse at a time corresponding to the trailing edge of the positive to negative transition of the astable multivibrator 86. The advance pulse causes the output of the step register 84 to advance to position 1 (see FIG. 4*n*).

In position 1, output signals are applied via the terminal 114*b* and the OR gate 150 to the water valve 50 and via the terminal 114*a* and the timing resistor RB to the terminal 130. The opening of the water valve 50 causes tap water to flow in a path from the source 70 through the valve 50 and turbulently into the tank 18 via the inlet 28 in what is commonly referred to as a pre-soak step. The water flows for approximately 45 seconds as controlled by the resistor RB.

The pre-soak step serves to cause the dry emulsion to swell such that it has a generally sponge-like characteristic. In this condition the emulsion has the capability of immediately absorbing the developer working solution when it is supplied and enhances the development mechanism.

At the end of this time, the voltage across the capacitor C is sufficient to trigger the astable multivibrator 86. As previously described, in response to the transition of the output of the astable multivibrator 86 the one-shot 136 provides an advance pulse at the terminal 112 which in turn causes the step register to advance to position 2. In this position (see FIG. 4*o*) output signals are present on the terminals 115*b* and 115*a* which are applied to the drain valve 42 through the OR gate 152 and to the timing resistor RC via the OR gate 146. In this step, commonly referred to as a drain step, the water in the tank 18 is drained through the valve 42 and the outlet conduit 56. At a time determined by the resistance of the resistor RC, the astable multivibrator 86 is again triggered to supply a pulse to one-shot 136 which in turn causes the step register to advance to position 3.

Position 3 is commonly referred to as the developing step. In this step, the developer valve 48 and the water valve 50 are opened so as to supply a diluted solution of developer from tanks 66 and 70 through the manifold 44 and turbulently into the well 18. As previously described, the developer working solution has a dilution of between 10 to 1 and 20 to 1. As the well 18 turbulently fills with the developer working solution, immediate development of the pre-soaked emulsion of the x-ray film 75 commences. Generally, the tank fills in about 15 seconds. In addition, an enable signal is applied via the terminal 116*a* and the OR gate 164 to the one-shot 162. When the level of the developer solution reaches that of the electrodes 34 and 36, a conductive path is formed between the electrodes, thereby providing a potential to one input of the comparator 160. When the level of this potential reaches the reference potential $V_{REF}$, applied to its other input, the comparator 160 supplies the signal represented in FIG. 4*h* to the enabled one-shot 162. The one-shot 162 produces a positive-going pulse as illustrated in FIG. 4*g* which triggers the one-shot 136 and which in turn causes the step register 84 to advance to position 4.

In position 4, the tank 18 is filled with the developer working solution and development of the x-ray continues. At a time determined by the selected resistance of the resistor RD when development is almost completed, i.e., 30 seconds, the astable multivibrator 86 transitions which causes the step register to advance to position 5.

Position 5 is commonly referred to as a wash operation. In this operation the output signal present on terminal 118*b* actuates the control terminal 51 causing the water valve 50 to open so that water turbulently flows from the source 70 into the inlet 28. The incoming water causes the developer to overflow the weir or spillway 24 and to be exhausted through the drain 30 under the force of gravity. Since the developer working solution first contacts the lower area of the x-ray film, this overflow technique enables the developer solution to contact all portions of the film for the same time period. The length of time that the water valve remains in this wash operation is determined by the resistance of the timing resistor RF. When the voltage across the capacitor C is sufficient to cause the astable multivibrator 186 to transition, the step register 84 is advanced to position 6 for another drain operation in which the drain valve is opened for a time determined by the resistance of timing resistor RC. This operation is similar to that previously described relative to position 2.

After the drain operation is completed, the step register is advanced to position 7 to begin the fixing step. In this position with the output appearing on terminal 120*b* the control terminals to the fixer valve 46 and the water valve 50 are actuated, thereby opening such valves and causing the tank 18 to fill in a turbulent manner with a diluted fixer working solution. In this step a timing resistor is not coupled to the astable multivibrator. Instead, as in step 3, the level sensing circuit 92 is utilized by providing an enable signal via the terminal 120*a* to the one-shot 162. Generally, this step requires about 15 seconds.

When the diluted fixer working solution in the tank 18 reaches the electrodes 34 and 36, the comparator 160 conducts and triggers the one-shot 162 which in turn causes the step register 84 to advance in a manner previously described in position 8.

Position 8 represents the fixing step. In this step fixing of the emulsion continues as long as the fixer remains in the tank. The duration of the step is determined by the selected resistance of resistor RE and preferably is about 80 seconds. The subsequent advance of the step register 84 into position 9 causes another drain operation to commence. In this operation the drain valve 42 is opened for a time determined by the resistance of resistor RC in the manner previously described during the second and sixth process steps. This allows the fixer to drain through the outlet 28 and the drain valve 42 to the outlet conduit 56.

After the fixer is drained, the step register is advanced to position 10 in order to effect another wash operation. In the wash operation, with the output present on terminal 123*b*, the water valve 50 is opened, permitting water to turbulently flow into the tank 18 and wash the film. The water valve 50 remains open for a time determined by the resistance of the resistor RG.

It should be recognized that this wash operation is similar to that described with the step register in position 5 but differs in that the wash time is determined by the resistor RG and is preferably about 45 seconds. This allows the time selected to wash the fixer from the film to be independent of that for washing the developer from the film.

A drain operation (position 11) follows the wash operation so as to allow the water to be exhausted from the tank 18. The drain operation is similar to that described with the step register in positions 2, 6 and 9.

After a time determined by the resistor RC the water is drained with the well 18 and the step register 84 is advanced into position 12. The output appearing on terminal 125*b* is conducted through the OR gate 104 to the master flip-flop 82 causing the output of the master flip-flop to go high (see FIG. 4*d*). This removes the enable signal from the terminal 106 of the step register 84 and the inverted enable signals from the inputs of the one-shot 136 and the astable multivibrator 86. With the enable signal removed, the apparatus 10 is in a standby condition and the processing of the film 75 is complete and can be removed from the apparatus.

In the standby condition, a manual wash operation of any desired duration is capable of being provided. In such operation, the manual wash switch 102 is closed, thereby providing a voltage via conductor 148 to the water valve 50 which allows water to enter the tank. As long as switch 102 is closed the water is allowed to enter the tank. When the operator is satisfied that the film is sufficiently washed to remove any traces of the previously used chemicals, e.g., developer or fixer, and it is desired to drain the water, the switch 102 is opened. This actuates the one-shot 170 and hence the drain valve 42 via the conductor 154 and the OR gate 152. During this manual operation, the master flip-flop 82 is disabled via a signal through the OR gates 172 and 104. This prevents the apparatus from commencing an operation should the start switch 101 be inadvertently depressed. The duration of the signal provided by the one-shot 170 is sufficient to enable the drain to remain open for a time sufficient to drain all of the fluid in the tank.

In an alternative embodiment, a fluid such as compressed air, nitrogen or the like is applied to dry the film prior to the step of advancing the step register into position 12. More particularly, the step register is modified to include an additional output between positions 11 and 12 and the manifold 44 is modified to include an additional solenoid valve of the type previously described. The outputs of the added valve are coupled to the control terminal of the valve and a timing resistor (not shown) to control the length of time that the valve remains open.

Figure 6:
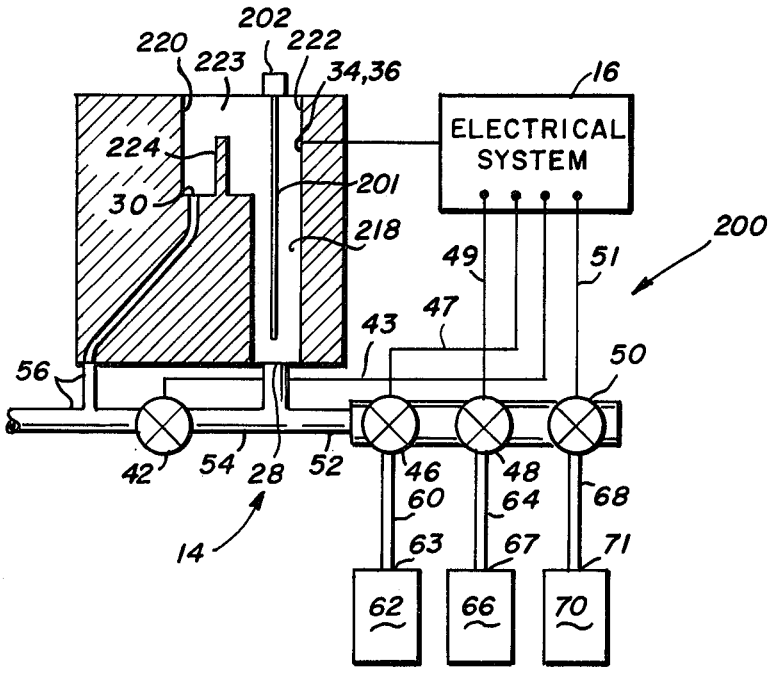
FIG. 6 is a cross-section view diagrammatically illustrating a second embodiment of an apparatus for processing x-ray film in accordance with the present invention.

Referring now to FIG. 6, an alternative embodiment of an apparatus for processing x-ray film made in accordance with the present invention is diagrammatically illustrated in a cross-section view. The apparatus is generally designated by the numeral 200. Many of the parts of the apparatus 200 are identical in construction to like parts in the apparatus 10 described above, and accordingly, there has been applied to each like part an identical reference numeral.

The fundamental difference between the apparatus of FIG. 6 and the apparatus illustrated in FIG. 1 and described previously is in the construction of the tank or well. It will be noted that the dimension between the front wall 222 and the rear wall 220 is much less and that the depth of such tank is much greater than that of the apparatus illustrated in FIG. 1. A well structure of this type shown lends itself to receiving 16 × 17 inch sheets of x-ray film which are commonly used in the medical profession. Such sheets 201 are hung from a hanger 202 which spans the opposite side walls 223 of the well so as to maintain the film in a generally vertical orientation. Although not shown it should be noted that the port 28 can be disposed through the lower portion of the side walls 223. In operation, the apparatus 200 functions as previously described.

From the above, it should be recognized that an apparatus and method for automatically processing x-ray film and the like have been described which fullfill all of the objects and advantages set forth above.

While the invention has been particularly shown and described with reference to certain preferred embodiments, it will be understood by those skilled in the art that various alterations and modifications in form and detail may be made therein. Accordingly, it is intended that the following claims cover all such alterations and modifications as fall within the true spirit and scope of the invention.

What is claimed is:

1. An apparatus for processing x-ray film comprising:

a processing tank having a first port disposed generally in its lower portion, said first port serving to provide an inlet and an outlet for working solutions flowing into or out of said tank;

a first valve having a first inlet, a first outlet and a first electrical control terminal, said first valve being normally closed and further being responsive to a first signal applied to said first terminal and operative to allow a developer solution to flow from its inlet to its outlet;

a second valve having a second inlet, a second outlet and a second electrical control terminal, said second valve being normally closed and further being responsive to a second signal applied to said second terminal and operative to allow a fixer solution to flow from its inlet to its outlet;

a third valve having a third inlet, a third outlet and a third electrical control terminal, said third valve being normally closed and further being responsive to a third signal applied to said third terminal and operative to allow water to flow from its inlet to its outlet;

conduit means interconnecting said first, second and third outlets and said first port;

a fourth valve having a fourth inlet connected to said conduit means, a fourth outlet and a fourth electrical control terminal, said fourth valve being normally closed and further being responsive to a fourth signal applied to said fourth terminal and operative to allow working solutions to flow from its inlet to its outlet;

a first source of photographic developer solution having a first orifice coupled to said first inlet and being capable of supplying developer solution to said first inlet;

a second source of photographic fixer solution having a second orifice coupled to said second inlet and being capable of supplying fixer solution to said second inlet;

a third source of water having a third orifice connected to said third inlet, said water having a pressure which is in a predetermined range between a first pressure and a second pressure and being subject to variations, said third orifice having a dimension sufficient to provide a turbulent flow of water to said tank when said third signal is applied to said third terminal and said pressure exceeds said first pressure; and first means for selectively supplying first, second, third and fourth signals to said first, second, third and fourth terminals, respectively, whereby when said first and third signals are applied, developer solution and water turbulently flow into said tank via said first and third valves to form a developer working solution, when said second and third signals are applied, fixer solution and water turbulently flow into said tank via said second and third valves to form a fixer working solution when said third signal is applied, water turbulently flows into said tank via said third valve, and when said fourth signal is applied, the liquids filling said tank are permitted to drain through said fourth outlet.

2. An apparatus for processing x-ray film as recited in claim 1 wherein said first pressure is about 30 psi and said second pressure is about 90 psi.

3. An apparatus for processing x-ray film as recited in claim 1 wherein the diameter of said third orifice is greater than that of said first and second orifices.

4. An apparatus for processing x-ray film as recited in claim 3 wherein said first and second sources have a pressure of about one-third that of said first pressure.

5. An apparatus for processing x-ray film as recited in claim 1 wherein said first means includes a source of DC potential;

second means responsive to the application of a DC potential and operative to provide a differentiated signal;

third means responsive to said DC potential and said differentiated signal and operative to provide an enable signal in response thereto;

step register means having a trigger input terminal and a plurality of output terminals, said step register means being responsive to said enable signal and a trigger signal and operative to provide an output signal on one of said output terminals in response to said trigger signal and further being operative to sequentially advance said output signal on another output terminal in response to a subsequent trigger signal, said output signal comprising said first, second, third and fourth signals;

fourth means coupled between said output terminals and said trigger input terminal and being responsive to said output signal and operative to develop said trigger signal; and fifth means selectively coupling said output terminals to said first, second, third and fourth terminals for applying said first, second, third and fourth signals to such terminals, respectively.

6. An apparatus for processing x-ray film comprising:

a processing tank having a first port disposed generally in its lower portion, said first port serving to provide an inlet and an outlet for working solutions flowing into or out of said tank;

a first valve having a first inlet, a first outlet and a first electrical control terminal, said first valve being normally closed and further being responsive to a first signal applied to said first terminal and operative to allow a developer solution to flow from its inlet to its outlet;

a second valve having a second inlet, a second outlet and a second electrical control terminal, said second valve being normally closed and further being responsive to a second signal applied to said second terminal and operative to allow a fixer solution to flow from its inlet to it outlet;

a third valve having a third inlet, a third outlet and a third electrical control terminal, said third valve being normally closed and further being responsive to a third signal applied to said third terminal and operative to allow water to flow from its inlet to its outlet;

conduit means interconnecting said first, second and third outlets and said first port;

a fourth valve having a fourth inlet connected to said conduit means, a fourth outlet and a fourth electrical control terminal, said fourth valve being normally closed and further being responsive to a fourth signal applied to said fourth terminal and operative to allow working solutions to flow from its inlet to its outlet;

a first source of photographic developer solution having a first orifice coupled to said first inlet and being capable of supplying developer solution to said first inlet;

a second source of photographic fixer solution having a second orifice coupled to said second inlet and being capable of supplying fixer solution to said second inlet;

a third source of water having a third orifice connected to said third inlet, said water having a pressure which is in a predetermined range between a first pressure and a second pressure and being subject to variations, said third orifice having a dimension sufficient to provide a turbulent flow of water to said tank when said third signal is applied to said third terminal and said pressure exceeds said first pressure; and first means including, a source of DC potential, second means responsive to the application of said DC potential and operative to provide a differentiated signal, third means responsive to said DC potential and said differentiated signal and operative to provide an enable signal in response thereto, step register means having a trigger input terminal and a plurality of output terminals, said step register means being responsive to said enable signal and a trigger signal and operative to provide an output signal on one of said output terminals in response to said trigger signal and further being operative to sequentially advance said output signal on another output terminal in response to a subsequent trigger signal, said output signal comprising said first, second, third and fourth signals;

fourth means coupled between said output terminals and said trigger input terminal, said fourth means including fifth means responsive to said output signal and operative to produce a pulse having a predetermined duration, an astable multivibrator responsive to said pulse and an inverted enable signal and operative to provide a fifth signal at a time corresponding to the trailing edge of said pulse, sixth means responsive to said fifth signal and said inverted enable signal and operative to develop said trigger signal, and seventh means for inverting said enable signal and applying same to said astable multivibrator and said sixth means; and eighth means selectively coupling said output terminals to said first, second, third and fourth terminals for applying said first, second, third and fourth signals to such terminals, respectively, whereby when said first and third signals are applied, developer and water solution turbulently flow into said tank via said first and third valves to form a developer working solution, when said second and third signal is applied, fixer and water solution turbulently flow into said tank via said second and third valves to form a fixer working solution, when said third signal is applied water turbulently flows into said tank via said third valve, and when said fourth signal is applied the liquids filling said tank are permitted to drain through said fourth outlet.

7. An apparatus for processing x-ray film as recited in claim 6 wherein said fifth means comprises a plurality of resistive elements, each having a resistance that is capable of being selectively adjusted and being connected between selected output terminals and said astable multivibrator.

8. An apparatus for processing x-ray film as recited in claim 6 and further comprising level detecting means disposed in said tank responsive to the level of solution in said tank and operative to provide an electrical indication when said level reaches a predetermined depth, ninth means responsive to said indication and said DC potential and operative to provide a sixth signal when said indication exeeds a reference level, tenth means coupled to selected output terminals and being responsive to said output signal and said sixth signal and operative to produce a seventh signal identical to said fifth signal, and an OR gate for conducting said fifth and said seventh signal to said sixth means.

9. An apparatus for processing x-ray film as recited in claim 8 wherein said level sensing means comprises two spaced-apart electrodes.

10. An apparatus for processing x-ray film as recited in claim 6 and further comprising eleventh means responsive to said DC potential and operative to develop said third signal, conductive means for connecting said eleventh means to said third terminal and switch means for selectively applying said DC potential to said eleventh means.

11. A method of processing x-ray film comprising:

providing a processing tank having a port in its lower portion and capable of having x-ray film disposed therein;

supplying a turbulent flow of water through the port to pre-soak the film;

draining the tank;

supplying water and developer from separate sources to provide a turbulent flow of developer working solution through the port;

supplying a turbulent flow of water through the port to cause the developer working solution to overflow and in turn be removed from the tank;

draining the tank;

supplying water and fixer solution from separate sources to provide a turbulent flow of fixer working solution through the port;

draining the tank;

supplying a turbulent flow of water through the port; and draining the tank.

12. A method of processing x-ray film as recited in claim 11 and prior to the pre-soak step, the step of draining the tank.

13. A method of processing x-ray film as recited in claim 11 and further providing a developer control valve connected to a source of developer solution, a fixer control valve connected to a source of fixer solution and a water control valve connected to a source of water and wherein the step of supplying a turbulent flow of developer working solution comprises the substeps of opening the developer control valve and the water control valve, sensing the level of the developer working solution in the tank and closing the developer control valve and the water control valve when the developer working solution reaches a predetermined level.

14. A method of processing x-ray film as recited in claim 13 wherein the step of supplying a turbulent flow of fixer working solution comprises the sub-steps of opening the fixer control valve and the water control valve, sensing the level of the fixer working solution in the tank and closing the fixer control valve and the water control valve when the fixer working solution reaches a predetermined level.

15. A method of processing x-ray film as recited in claim 13 wherein the source of water supplies water having a pressure in a predetermined range between a first pressure and a second pressure, and further providing an orifice in said source of water having an areal dimension sufficient to produce a turbulent flow of water to the tank for all pressures in the predetermined range.

16. A method of processing x-ray film as recited in claim 11 and following the fourth drain step the steps of supplying a turbulent flow of water through the port and thereafter draining the water from the tank.

* * * * *